US005894712A

United States Patent [19]

Segers

[11] Patent Number: 5,894,712

[45] Date of Patent: Apr. 20, 1999

[54] REARRANGEMENT DEVICE FOR CONTAINER WITH LOOSE ARTICLES AND/OR PRODUCTS, AND REARRANGEMENT METHOD

[75] Inventor: Walter Segers, Evergem, Belgium

[73] Assignee: Resilux, Wetteren, Belgium

[21] Appl. No.: 08/666,459

[22] PCT Filed: Dec. 27, 1994

[86] PCT No.: PCT/BE94/00098

§ 371 Date: Jun. 27, 1996

§ 102(e) Date: Jun. 27, 1996

[87] PCT Pub. No.: WO95/18043

PCT Pub. Date: Jul. 6, 1995

[30] Foreign Application Priority Data

Dec. 27, 1993 [BE] Belgium ..... 09301474

[51] Int. Cl.[6] ..... B65B 01/22

[52] U.S. Cl. ..... 53/525; 53/502

[58] Field of Search ..... 53/525, 437, 502; 141/74, 75, 78

[56] References Cited

U.S. PATENT DOCUMENTS

| | | | |
|---|---|---|---|
| 2,353,492 | 7/1944 | O'Connor | 141/74 |
| 2,795,990 | 6/1957 | Bohlman et al. | 141/74 |
| 3,376,905 | 4/1968 | Lau | 141/76 |
| 3,533,454 | 10/1970 | Tinsley | 141/10 |
| 3,618,285 | 11/1971 | Russell | 53/437 |
| 3,868,809 | 3/1975 | Bledsoe | 53/525 |
| 4,907,396 | 3/1990 | McClusky et al. | 53/525 |
| 5,109,651 | 5/1992 | Stuart | 53/502 |
| 5,240,323 | 8/1993 | Haber et al. | 366/130 |

FOREIGN PATENT DOCUMENTS 2548135 5/1983 France .

*Primary Examiner*—James F. Coan
*Assistant Examiner*—Gene L. Kim
*Attorney, Agent, or Firm*—Ladas & Parry

[57] ABSTRACT

Device for subjecting a container containing products in bulk form to a movement, in which a set of movement means is provided for said movement, said movement means consisting of toss-up means which are formed by a set of bellows which are controllable in a predetermined way, which is such that the container for placing on a frame of the device with which the bellows interact is subjected to a toss-up movement in a particular sequence at various sides thereof, in order to rearrange the products in said container and method therefor.

21 Claims, 5 Drawing Sheets

REARRANGEMENT DEVICE FOR CONTAINER WITH LOOSE ARTICLES AND/OR PRODUCTS, AND REARRANGEMENT METHOD

BACKGROUND OF THE INVENTION

This invention relates to a rearrangement device for a container containing loose articles and/or products, in particular in bulk form, comprising a bearing framework in which a set of movement means is provided, for subjecting the container interacting with said bearing framework to a movement.

PRIOR ART

In the case of known devices of this type means are provided for subjecting the container to a shaking movement, said means comprising reciprocating elements such as cylinders, in particular compressed air cylinders.

However, these elements have the disadvantage that they themselves are rigid and are thus a fixed height. During handling of the containers, namely loading onto and unloading from the rearrangement device, the container consequently has to be raised to a suitable height or lowered therefrom beforehand in each case. This requires equipment suitable for the purpose, such as a fork-lift truck.

Another disadvantage is that the cylinder elements are moved only in their lengthwise direction. The container can therefore only be shaken in this direction.

Yet another disadvantage is that such cylinders carry out a rather clumsy movement, in the case of which account must be taken of the inertia effect of the cylinder mass and also of the internal friction of the cylinders.

SUMMARY OF THE INVENTION

The object of the invention is to eliminate the abovementioned disadvantages. To this end, in the case of the device according to the invention it is characteristic that the abovementioned movement means consist of toss-up means formed by bellows which are controllable in a predetermined way, which is such that the container to be placed on a frame of the device with which the bellows interact is subjected alternately at opposite sides thereof to a toss-up movement, for the rearrangement of the products in said container.

This considerably simplifies the design of the device, since the bellows need not be moved as a whole, but it is the bellows themselves which undergo a shape change under a suitable control, in particular an expansion followed by a contraction. Subsequent shape changes of predetermined bellows according to a controlled sequence cause the toss-up movement of the container. Moreover, this alternating expansion and contraction of the bellows does not occur only in one particular direction, but in a direction which can vary slightly. This is due to the flexible structure of the bellows. An extremely smooth operation of the device is obtained in this way. Due to this variation being possible in the direction of the toss-up movement produced by the bellows, a better distribution of the bulk material placed in the container is obtained.

Another advantage of the bellows in this device is the extremely low height of the bellows in the contracted idle position. This makes it possible to dispense with expensive handling equipment such as fork-lift trucks for loading the containers onto and/or unloading them from the device.

Even manual handling of the containers relative to the device is a possibility in these circumstances. Besides, from the point of view of safety, this makes it possible to work in less dangerous conditions. This actually means that the fork-lift truck can be removed from the production process. There is also considerably less risk of damage to the device and/or container and/or bulk contents of the container.

A further important advantage is the extremely low inertia of the abovementioned bellows. This produces much greater acceleration in the bulk material placed in the container, and better filling of the so-called empty spaces in the bulk material is obtained.

Further features and characteristics of the invention are defined in the sub-claims.

Further advantages and details will emerge from the description below of an exemplary embodiment of a device according to the invention with reference to the appended drawings.

DESCRIPTION OF THE INVENTION

Figure 1:
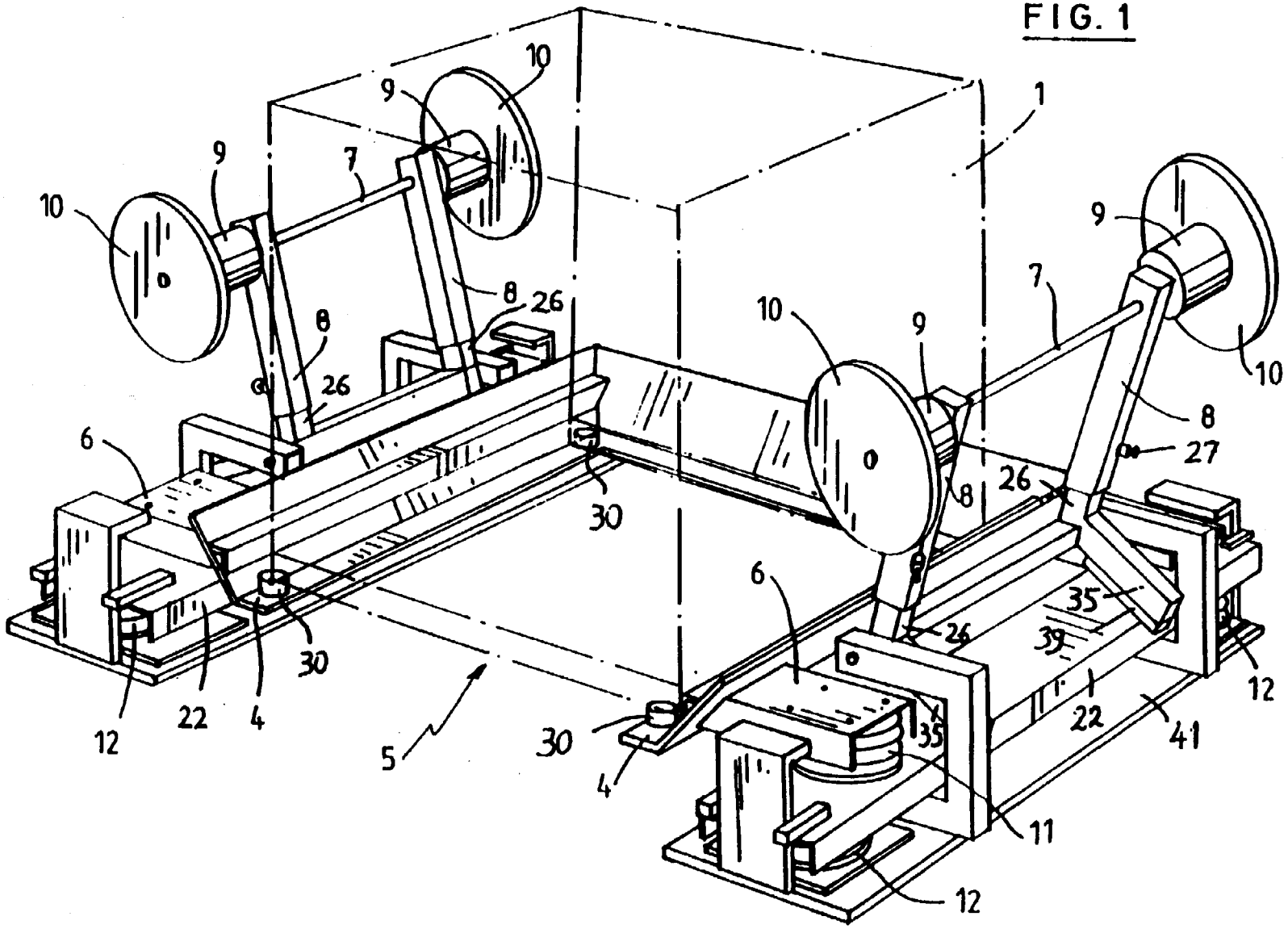
FIG. 1 is a general perspective view of the device according to the invention in the idle position, with a container resting thereon.

FIG. 1 shows a rearrangement device 90 according to the invention. It comprises a bearing framework 4, for supporting a container 1, in particular a packing box in which the articles contained are products in bulk form. When the bulk products are being packed they are usually emptied in bulk into the packing box, in the course of which the articles assume an arbitrary orientation relative to each other. The result of this is that relatively large hollow spaces are formed between the articles, which means a loss of effective storage capacity in the packing box.

The bearing framework 4 is virtually parallel to the ground, and is set up a slight distance from the ground, in such a way that it is movable relative to a frame 41. The structure consisting of the frame 41 and the bearing framework 4 preferably has an open side 5, in such a way that a transportation unit 3, e.g. a pallet, intended for handling the container 1 can be pushed onto the bearing framework 4 and a stable support on three sides is achieved in this way. The bearing framework 4 is thus U-shaped, as can be seen from FIG. 1.

The two opposite sides of the bearing framework 4 have at their two ends a toss-up means 11, which is preferably compressible. Two adjacent toss-up means lying at the same side of the bearing framework are supported by a longitudinal beam 22 in each case. The two longitudinal beams 22 are in turn supported by preferably compressible lifting means 12. For example, a toss-up means 11 is provided virtually at the level of each lifting means 12.

Said toss-up means 11; 12 are preferably formed by inflatable bellows, which to this end are each individually connected in a known manner to compressed air valves. The latter permit a regulation of the air supply to the bellows 11, 12 respectively. The toss-up means 11 are each connected to the bearing framework 4 by means of a profiled connecting piece 6, in such a way that they interact intimately. The abovementioned profiled connecting pieces 6 permit a transfer of the pressure variation, and thus of the volume variation, from the toss-up bellows 11, to the bearing framework 4. A volume variation of the bellows can thus be converted into an up and down movement of the bearing framework 4. A suitable regulation of the air supply to the lifting bellows 12 can ensure a suitable upward movement of the bearing framework 4, and thus also of the container 1, by way of the longitudinal beams 22, which thus act as transfer elements.

Imposing a particular pattern on the air supply, in the case of which the controllable parameters are, inter alia, duration and frequency, can thus ensure that a desired toss-up movement is imposed on the container 1. Bulk material placed in the container can consequently be rearranged in a suitable manner under the influence of gravity, in such a way that the lost space between the articles in bulk form is minimized. Said articles can be toys, ornamental articles, components and the like. According to a particularly advantageous application of the invention, the articles are PET preforms.

The profiled connecting pieces 6 are, e.g., a downward facing U-shape and are fixed at one longitudinal end to the bearing framework 4, with the result that a sturdy connection is ensured. The toss-up bellows 11 are preferably fitted virtually at the opposite free end of each connecting piece 6, in order to obtain a greater power transmission from bellows to bearing framework in this way, through the lever effect.

The rearrangement device is also provided with clamping means for clamping the container 4 during the toss-up movement. Said clamping means comprise a set of bars 7 which can be tightened against the container 4. To this end, the bars 7, which are disposed virtually parallel to said longitudinal beam 22, are fitted in such a way that they can rotate in the direction of arrow G (FIG. 4) relative to the frame 41 by means of a set of connecting arms 8. The latter are provided at their free end with a folded part 35 which rests on the longitudinal beam, preferably by means of a damping strip 39.

Figure 2:
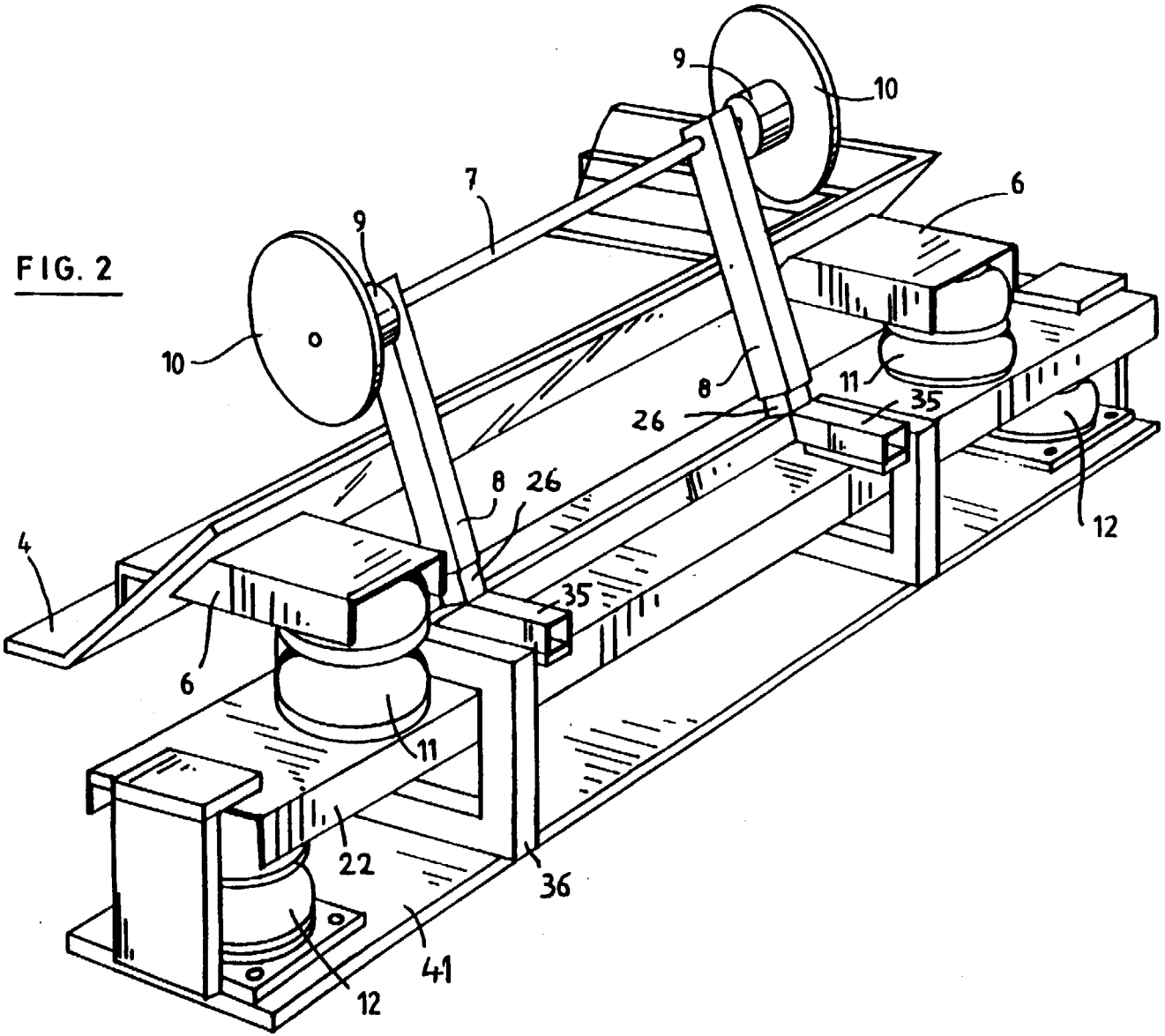
FIG. 2 is a partial view according to FIG. 1, in which the device is in operation.

Both pairs of connecting arms 8 advantageously have an adjustable length, by means of which the bars can be adjusted to the correct height relative to the side walls of the container 4. This means that the device 90 can be used without any difficulty at all on containers of a wide height and/or width range. For this purpose, provision is made for, e.g., a further set of connecting arms 26, on which the abovementioned connecting arms 8 are slidable and can be clamped at the desired height by means of a pressure element 27. In this case it is each further connecting arm 26 which has a bent-over part 35 at its free end, as shown in FIGS. 1 and 2.

Figure 6:
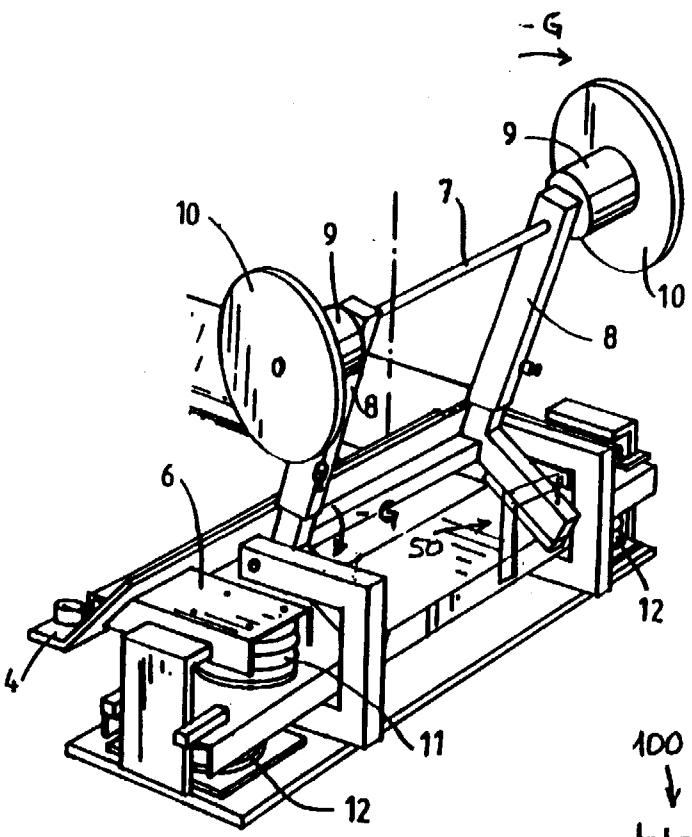
FIGS. 6 and 7 are detail views of a variant of the device in the idle and in the working position respectively.
Figure 8:
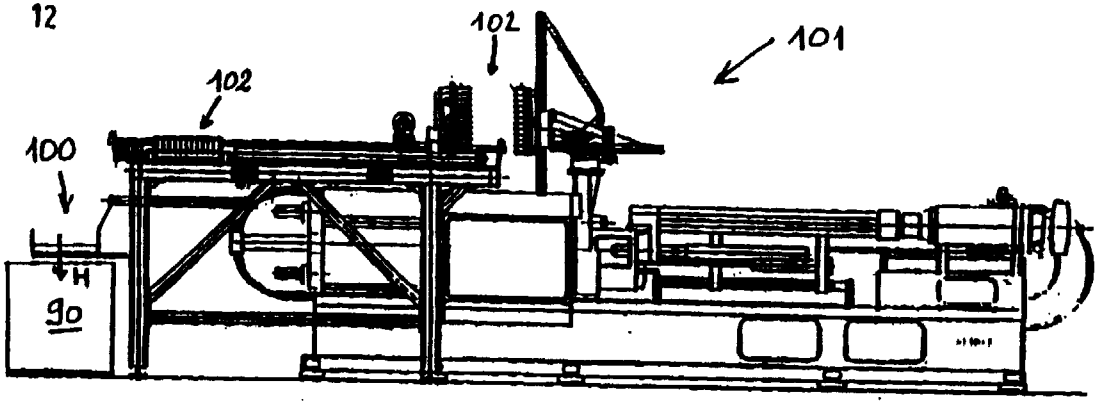
Figure 7:
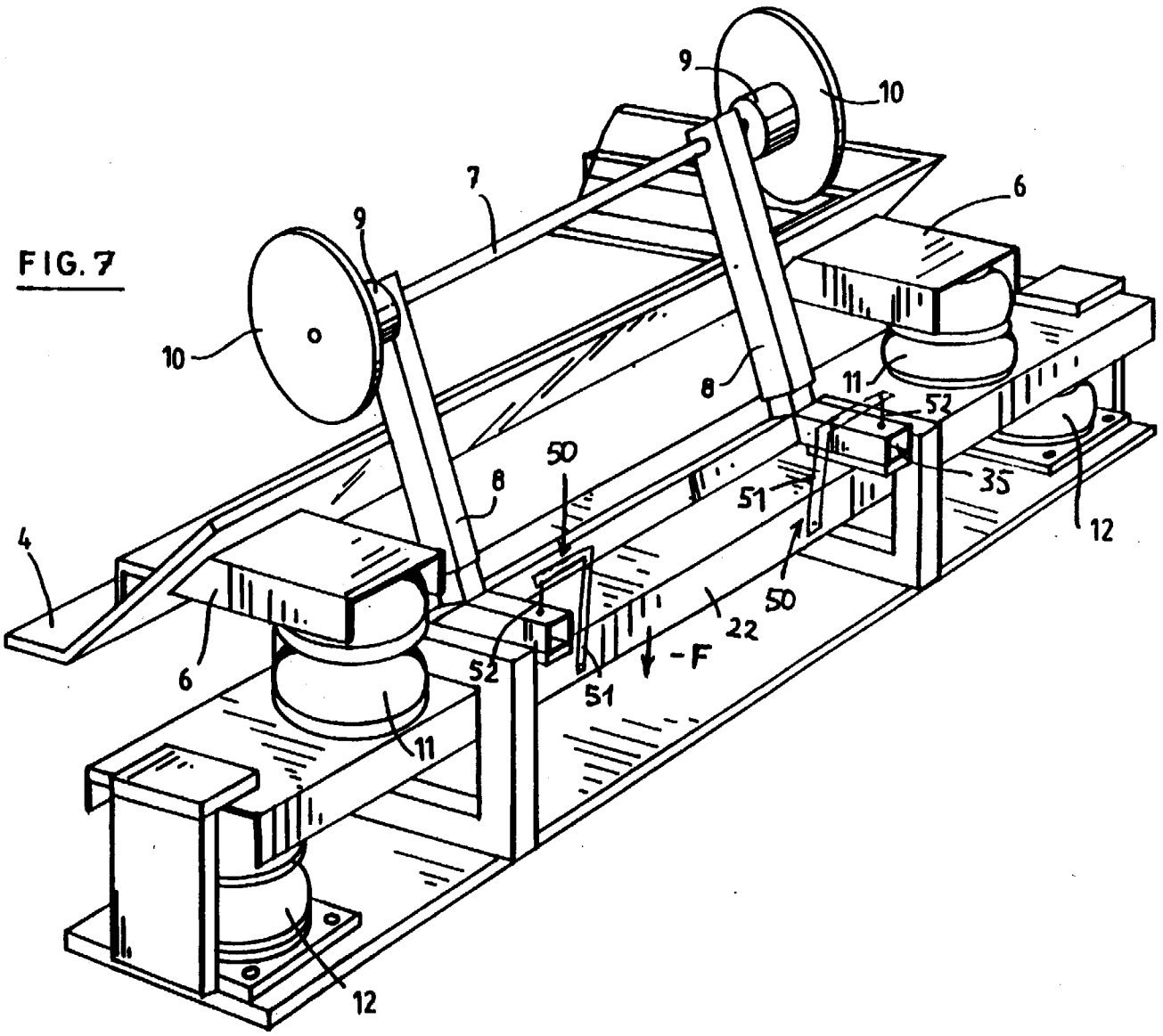

According to a variant proposed in FIGS. 6 and 7, a feedback element 50 is advantageously provided between the projecting or bent-over part 35 of each arm and the longitudinal bearing beam. These feedback elements provide a feedback action from the longitudinal beam 22 to the corresponding arms 35 in the direction of arrow –G when the longitudinal beams 22 are sagging (–F). This prevents the clamping means from becoming caught on the container 1 after the compressed air supply to the bellows 12 has been turned off.

The abovementioned feedback elements 50 are advantageously adjustable as a function of the type of container. The feedback elements in this case consist of, for example, a hook 51 which at one end is immovably connected to the longitudinal beam 22 and at the other end is provided with an adjustable screw 52 provided there and acting upon the end 35 of the arm, in the direction of arrow –F.

At both ends of each clamping bar 7 damping bushes 9 are provided, in order to ensure a supple clamping of the container and at the same time a virtually negligible risk of damage thereto if the clamping bars 7 revolve against the container or during the toss-up movement thereof. In order to reduce the resistance between the rubbing surfaces of the container 1 and the damping bushes 9, the latter are fitted so that they are freely rotatable about each clamping bar 7. At the free end of each damping bush 9 a disc 10 which is virtually concentric therewith is also provided, the diameter of said disc being greater than that of the damping bush. The discs 10 make it possible to prevent a shift in the container parallel to the clamping bars 7, and thus ensure an efficient and reliable clamping.

As in the case of the connecting arms 8, the clamping bars 7 can also be such that they are adjustable in length through bars sliding into one another. Damping bush and disc can also be integral.

A control unit is preferably also provided, for determining and checking a set threshold value with regard to the container, for example scales 2, which will not be described in any further detail.

The scope of this invention also covers a system comprising at least two devices 90 which are put into operation alternately. Continuous operation can thus be ensured, with a regular supply of rearranged containers. The system in this case can be executed in conjunction with a conveyor belt for the supply and discharge of the containers to and from the devices 90 respectively.

The device is also adjustable as regards the duration and frequency of the toss-up movement and as regards its pattern. Other parameters, such as weight of the container to be received, can also be made adjustable.

The operation of the device 90 according to the invention is described below.

Figure 3:
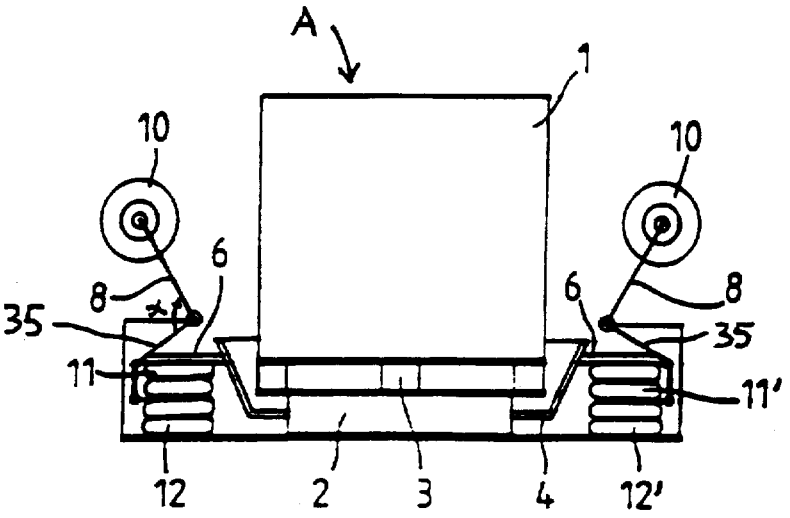
FIGS. 3 to 5 show diagrammatically the device according to the invention in various successive working stages.

The container 1 is first placed on the bearing framework 4 of the toss-up device 90 and weighed there by means of the weighing unit 2. All bellows 11, 12 are in the idle position shown in FIG. 3 (idle position A of the device).

The device is then switched on. In this way a toss-up movement is selected as a function of the load (weight of the container), type of products or articles, and the like.

The container is also centred relative to the device, in order to achieve good functioning of the tossup movement and of the clamping.

For this, centring elements 30 are advantageously provided, relative to which elements the container is easily positioned (FIG. 1). Said centring elements 30 can be made adjustable, e.g. slidable, as a function of the dimensions of the container 1 to be accommodated. Optimum functioning of the weighing unit 2 can be obtained in this way.

In a subsequent step the lifting bellows 12 are inflated by appropriately acting upon the compressed air valves for supplying air thereto. The container 1 together with the bearing framework 4 on which it is resting is thus raised a certain distance relative to the scales 2 by means of the rising longitudinal beams 22. This produces an open space 32 between the latter and the bearing framework 4, and this space remains during all of the actual toss-up cycle. This gives the considerable advantage that the weighing unit 2 cannot be damaged by the toss-up movements of the device (waiting position B of the device, which constitutes the preparatory phase for the actual rearrangement step). The rise of the longitudinal beams 22 causes the bent-over ends 35 of the arms also to be raised, and the arms are rotated in their entirety in the direction of arrow G.

Figure 4:
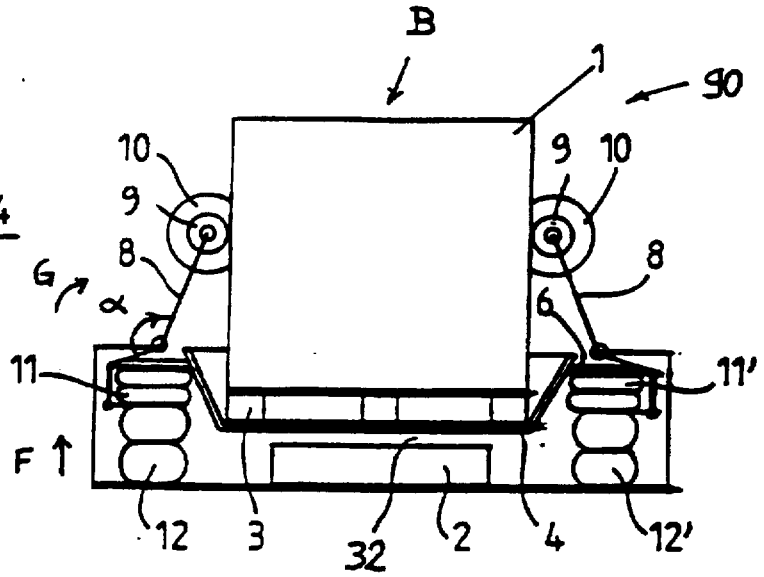

The clamping system, comprising clamping bars 7 and connecting arms 8 is rotated against the two transverse walls of the container. In the course of this, the length of the connecting arms 7 is adjusted until the side walls of the container are at a suitable height to ensure good stability thereof during the entire toss-up cycle. This is shown in FIG. 4.

Provided that there is a suitable adjustment of the length of the clamping bars 7, the latter are pressed against the container 1 by way of the damping bushes 9, and the discs 10 are pressed virtually against the two longitudinal walls of the container. Said walls prevent the container from falling out at the sides of the device.

Figure 5:
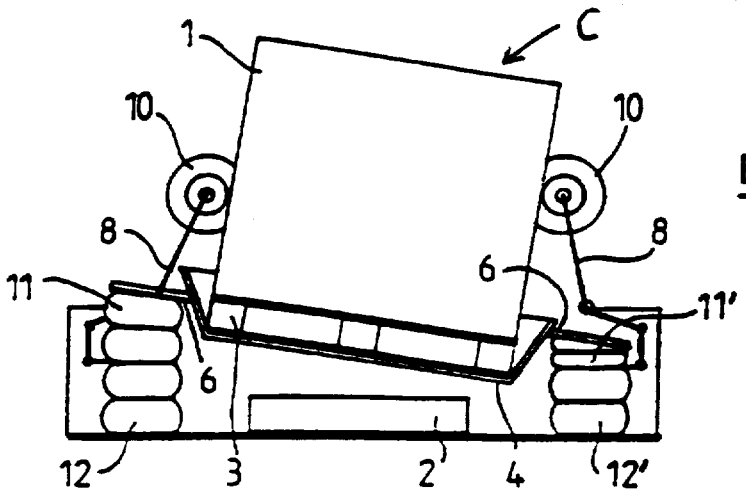

The top set of toss-up bellows 11 is then turned on, in order to start up the actual toss-up cycle, a momentary position C of which is shown in FIG. 5.

As a result of the selection of a toss-up pattern, the toss-up bellows 11 are inflated in a particular sequence by supplying air through controlled opening of the corresponding compressed air valves. This means that, for example, two toss-up bellows 11 resting against each other are acted upon simultaneously in each case, while the two remaining bellows are in the idle position shown in FIG. 5. Through imposing short, but relatively forceful impulse movements in this way on the container 1 in each case, the bulk contents thereof also undergo movements, in such a way that the spaces between the bulk articles or products are reduced to a minimum, with the minimum risk of damage to the articles or products, thanks to the smooth functioning of the bellows. The uniformity of the advantageous rearrangement inside the container is greatly promoted by varying the pair of toss-up bellows 11, 11 or 11', 11' used according to a chosen toss-up pattern. Said bellows can be either two adjacent toss-up bellows 11 at the same side of the bar, i.e. a transverse side of the device, or two adjacent toss-up bellows 11 at the same longitudinal side thereof (pair of bellows 11, 11').

An empty container can also be placed on the rearrangement device and weighed continuously there by means of the weighing unit 2 during the filling process. The feedback elements 50 described above ensure that the weighing can be carried out extremely reliably, and excellent measuring results are consequently obtained.

In a special application the rearrangement device is placed at the outlet of a device for manufacturing articles, in particular hollow articles, of the type described in Patent Application No. PCT/BE 94/00007, i.e. at the left end of the device shown there in FIG. 1 in such a way that a filling process can commence.

As described above, the weighing unit 2 is set at a particular value. When the set value of the weighing unit 2 is reached in the filling process the toss-up cycle described above can be turned on, and further filling can be stopped for the present.

This can also be carried out at regular set intervals, in order to achieve homogeneous filling of the container 1. This promotes the optimum degree of filling.

In order to permit continuous operation of the abovementioned production device, the above-described system, comprising several rearrangement devices 90, can advantageously be employed, for example, in a series arrangement, in which the further devices are set up downstream of the outlet.

In this way a further value is set for the weighing unit corresponding to the first rearrangement device, said value being lower than the actual critical setting value defined earlier which was applied to the further rearrangement device set up downstream.

When the abovementioned lower setting value is reached, the partially filled container 1 is discharged and transferred to the further rearrangement device downstream. On the first rearrangement device the discharged container 1 is replaced by an empty container for filling, while the discharged container 1 is filled further until the set value of the rearrangement device downstream is reached. A very high degree of automation of the production process, including the packing phase, is thus obtained, with extremely high efficiency.

I claim:

1. In a device for settling a number of articles in random orientations in a container, the improvements of said device comprising:

a support frame for supporting said container, said support frame having various peripheral locations;

a plurality of shaking means for selective activation to create reciprocating vertically directed impulses respectively on said various peripheral locations of said support frame, each of said shaking means comprising a fluid chamber for movement from a retracted to an expanded position and vice-versa; and control means for selecting said shaking means and controlling both a sequence and duration of said movement thereof.

2. The device according to claim 1, wherein each said shaking means (11) is a bellows.

3. The device according to claim 1, and further comprising a set of lifting means (12) for lifting said support frame (4).

4. The device according to claim 3, wherein said lifting means (12) are further bellows.

5. The device according to claim 3, and further comprising means for controlling said lifting means (12) independently of said shaking means (11).

6. The device according to claim 2, wherein said shaking means (11) provide said impulses to said support frame (4) by means of respective profiled connecting pieces (6).

7. The device according to claim 6, wherein each one of said profiled connecting pieces (6) has a downward facing U-shape inside which respective ones of said bellows (11) are disposed substantially at one end of said one of said connecting pieces, an opposite end of said one of said connecting pieces being immovably connected to said support frame (4).

8. The device according to claim 3, and further comprising clamping means for clamping said container (1) to said frame during said movement.

9. The device according to claim 8, wherein said clamping means comprise a set of laterally clamping bars (7).

10. The device according to claim 9, wherein said laterally clamping bars (7) are rotatably connected to said support frame (4) by means of a set of connecting arms (8) each having a freely projecting part (35) which is rotatable by said lifting of said lifting means (12), transfer elements (22) being respectively provided between said lifting means (12) and each said freely projecting part (35).

11. Device according to claim 10, and further comprising feedback elements (50) respectively between each said freely projecting part (35) and transfer elements (22) for providing a feedback action from said transfer elements to said connecting arms.

12. The device according to claim 11, and further comprising means for adjusting each of said feedback elements.

13. The device according to claim 10, and further comprising means for adjusting a height of each of said connecting arms (8).

14. The device according to claim 9, and further comprising substantially cylindrical damping bushes (9) respectively disposed over opposite ends of each of said clamping bars.

15. The device according to claim 14, wherein said damping bushes (9) are respectively freely rotatable about each of said clamping bars (7).

16. The device according to claim 14, and further comprising discs (10) respectively concentrically at free ends of each of said damping bushes (9) with a larger diameter than said damping bushes.

17. The device according to claim 16, wherein said damping bushes (9) and discs (10) are integral.

18. The device according to claim 1, and further comprising a control unit for determining and checking a set threshold values of said container.

19. The device according to claim 18, wherein said control unit comprises scales (2).

20. The device according to claim 1, and further comprising means for adjusting at least one of a duration of said impulses, a frequency of said impulses or in response to a weight of said container (1).

21. The device according to claim 1, wherein said support frame (4) is open (5) at least at one transverse side.

* * * * *